US007125459B2

(12) United States Patent
Cho

(10) Patent No.: US 7,125,459 B2
(45) **Date of Patent: *Oct. 24, 2006**

(54) HIGH STRENGTH ALUMINUM ALLOY

(75) Inventor: Alex Cho, Darien, IL (US)

(73) Assignee: Pechiney Rolled Products LLC, Ravenswood, WV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/018,262

(22) Filed: Dec. 21, 2004

(65) Prior Publication Data

US 2005/0189048 A1 Sep. 1, 2005

Related U.S. Application Data

(63) Continuation of application No. 10/000,147, filed on Oct. 19, 2001, now Pat. No. 6,869,490.

(51) Int. Cl.
*C22F 1/057* (2006.01)

(52) U.S. Cl. ..... 148/698; 148/699

(58) Field of Classification Search ..... 148/698, 148/699, 416, 437, 438

See application file for complete search history.

(56) References Cited

U.S. PATENT DOCUMENTS

| | | | |
|---|---|---|---|
| 2,248,185 | A | 7/1941 | Nock, Jr. |
| 3,198,676 | A | 8/1965 | Sprowls |
| 3,231,435 | A | 1/1966 | Rotsell, Jr. |
| 3,305,410 | A | 2/1967 | Sublett |
| 3,881,966 | A | 5/1975 | Staley et al. |
| 3,947,297 | A | 3/1976 | Reimann et al. |
| 4,030,947 | A | 6/1977 | Kemper |
| 4,214,925 | A | 7/1980 | Arita et al. |
| 4,305,763 | A | 12/1981 | Quist et al. |
| 4,409,038 | A | 10/1983 | Weber |
| 4,495,001 | A | 1/1985 | Bennett et al. |
| 4,603,029 | A | 7/1986 | Quist et al. |
| 4,861,391 | A | 8/1989 | Rioja et al. |
| 4,929,283 | A | 5/1990 | King et al. |
| 5,108,520 | A | 4/1992 | Liu et al. |
| 5,226,983 | A | 7/1993 | Skinner et al. |
| 5,439,536 | A | 8/1995 | Cho |
| 5,455,003 | A | 10/1995 | Pickens et al. |
| 5,865,911 | A | 2/1999 | Miyasato et al. |
| 5,922,147 | A | 7/1999 | Valtierra-Gallardo et al. |
| 6,074,498 | A | 6/2000 | Waldron et al. |

FOREIGN PATENT DOCUMENTS

| | | |
|---|---|---|
| RU | 707373 | 6/1981 |
| WO | 02/10466 A2 | 2/2002 |

OTHER PUBLICATIONS

"Aluminum and Aluminum Alloys", ASM International, 1993, p. 145.*

PCT Search Report for International Application No. PCT/US01/45326 dated Jul. 15, 2002; 3 pages.

"ASM Specialty Handbook® : Aluminum and Aluminum Alloys", ASM International, 1993 (3 pages).

Article from Materials Science Forum vols. 331-337 © 2000 Trans Tech Publications, Switzerland entitled "Alternate Heat Treatments of C458 Aluminum Lithium Alloy"; 7 pages.

"Aluminum-Lithium Alloys", ASM International, (1993), pp. 30, 121-123, 292.

* cited by examiner

*Primary Examiner*—Roy King
*Assistant Examiner*—Janelle Morillo
(74) *Attorney, Agent, or Firm*—Jenkens & Gilchrist

(57) ABSTRACT

A process for thermally treating an article made from an alloy comprising at least aluminum and copper. The process comprises solid solution heat treating the article, quenching the article, heating the article to a first temperature of from about 275 to about 340° F. and artificially aging. The article is artificially aged at the first temperature for a duration of at least 30 minutes. The article is artificially aged at a second temperature of from about 325 to about 380° F. for a duration of from about 4 hours to about 36 hours. The second temperature is greater than the first temperature by at least 10° F.

6 Claims, No Drawings

HIGH STRENGTH ALUMINUM ALLOY

This application is a continuation of U.S. application Ser. No. 10/000,147, entitled "High Strength Aluminum Alloy," filed on Oct. 19, 2001, which is U.S. Pat. No. 6,869,490. U.S. application Ser. No. 10/000,147 is incorporated by reference in its entirety.

FIELD OF THE INVENTION

The present invention relates generally to copper-bearing aluminum alloys and processes for making the same. More specifically, the present invention is related to age-hardenable, high strength aluminum alloys and processes of making the same.

BACKGROUND OF THE INVENTION

Aluminum alloys have been used in the past in forming a variety of articles or products for structural applications. Some of those aluminum alloys are used in, for example, the aerospace industry. Designers and manufacturers in the aerospace industry are constantly trying to improve fuel efficiency and product performance. One method for improving such items is to produce lightweight materials that still maintain or even improve relative strength.

The strengthening of age-hardenable aluminum alloys has traditionally involved solid solution heat treating, quenching and natural or artificial aging. Natural aging generally consists of allowing the solution heat treated aluminum alloy article to keep at about room temperature for a significant period of time. It is, however, commercially more feasible to artificially age these articles for shorter times at higher temperatures than room temperature. The strengthening of some aluminum alloys may include cold work, such as compression or stretching of the article. Cold work is typically performed on the age-hardenable aluminum alloy article before it is aged.

Accordingly, a need exists for a high strength aluminum alloy and processes for making the same.

SUMMARY OF THE INVENTION

According to one process, an article made from an alloy comprising at least aluminum and copper is thermally treated. The process comprises solid solution heat treating the article, quenching the article, heating the article to a first temperature of from about 275 to about 340° F. and artificially aging. The article is artificially aged at the first temperature for a duration of at feast about 30 minutes. The article is artificially aged at a second temperature of from about 325 to about 380° F. for a duration of from about 4 hours to about 36 hours. The second temperature is greater than the first temperature by at least 10° F.

According to another process of the present invention, an article is hot deformed and fast cooled. The article is comprises at least aluminum and copper. The article is heated to a first temperature of from about 275 to about 340° F. The article is artificially aged at the first temperature for a duration of at least 30 minutes. The article is artificially aged at a second temperature of from about 325 to about 380° F. for a duration of from about 4 to about 36 hours. The second temperature is greater than the first temperature by at least 10° F.

DETAILED DESCRIPTION OF THE ILLUSTRATIVE EMBODIMENTS

The aluminum alloy articles or products of the present invention have high strengths. The aluminum alloys of the present invention include Al—Cu (Aluminum-Copper) based alloys, Al—Cu—Li (Aluminum-Copper-Lithium) based alloys and Al—Li—Cu based alloys. Copper is desirable because it assists in increasing strength without losing fracture toughness significantly by forming copper-containing precipitate particles. Lithium is often desirable because it results in significant density and weight reduction to the aluminum alloys, while increasing the strength and elastic modulus of those alloys.

Other contemplated aluminum alloys of the present invention include Al—Cu—X, where X may be selected from materials such as zinc, magnesium, silver, manganese, silicon and lithium, and grain refiners such as zirconium, chromium, vanadium, indium, iron, hafnium, yttrium, lanthanides and combinations thereof. Similarly, the aluminum alloys may include Al—Cu—Li—Y or Al—Li—Cu—Y, where Y can be selected from materials such as zinc, magnesium, silver, manganese, silicon, zirconium, chromium, vanadium, indium, iron, hafnium, ytrrium, lanthanides and combinations thereof.

The aluminum alloy articles or products of the present invention comprise various compositions. The aluminum alloys of the present invention generally comprise from about 0.1 to about 10 wt. % copper, with the remainder aluminum. The aluminum alloys of the present invention generally comprise from 0 to about 6 wt. % optional lithium and, more specifically, from 0 to about 5 wt. % optional lithium. More specifically, the aluminum alloys comprise from about I to about 6.5 wt. % copper and from about 0.5 to about 3 wt. % lithium, with the balance aluminum and incidental elements and impurities.

The optional element of zinc is generally from 0 to about 9 wt. % and, more specifically, from 0 to about 4 wt. % of the aluminum alloy. The optional element of magnesium is generally from 0 to about 8 wt. % and, more specifically, from 0 to about 4 wt. % of the aluminum alloy. The optional element of silver is generally from 0 to about 2 wt. % and, more specifically, from 0 to about 1 wt. % of the aluminum alloy.

The optional element of manganese is generally from 0 to about 2 wt. % and, more specifically, from 0 to about 1 wt. % of the aluminum alloy. The optional element of silicon is generally from 0 to about 12 wt. % and, more specifically, from 0 to about 1 wt. % of the aluminum alloy.

The optional element of zirconium is generally from 0 to about 0.3 wt. %, while the optional element of chromium is generally from 0 to about 0.5 wt. % of the aluminum alloy. The optional element of vanadium is generally from 0 to about 0.3 wt. %, while the optional element of indium is generally from 0 to about 1 wt. % of the aluminum alloy.

One example of an aluminum alloy of the present invention that may be formed is Aluminum Alloy 2195. Aluminum Alloy 2195 nominally comprises 94.3 wt. % of aluminum, 4 wt. % copper, 1 wt. % lithium, 0.3 wt. % magnesium, 0.3 wt. % silver and 0.1 or, more specifically, 0.12 wt. % zirconium.

The aluminum alloy articles formed by the present invention have high strengths as measured by ultimate tensile strength (UTS) and tensile yield strength (TYS). Ultimate tensile strength is determined by ASTM E557, while tensile yield strength is determined by ASTM E557. The ultimate tensile strength of an aluminum alloy article of the present invention at room temperature is generally greater than about 55 kilopounds per square inch (ksi), preferably greater than about 70 ksi and most preferably greater than about 75 ksi. The tensile yield strength of an aluminum alloy article of the present invention at room temperature is generally greater than about 50 ksi, preferably greater than about 60 ksi and most preferably greater than about 65 ksi.

The aluminum alloy article of the present invention also has a desirable elongation. The elongation of the aluminum alloy article is determined by ASTM E557. The elongation of an aluminum alloy article of the present invention at room temperature is generally greater than about 4%, preferably greater than about 6% and most preferably greater than about 8%.

Solid solution heat treatment is traditionally performed on age-hardenable wrought aluminum alloy articles or products. The wrought article is formed from a hot deformation or fabrication process to its desired shape. The solid solution heat treatment embeds the aluminum alloy components in solid solution in a generally uniform manner throughout the aluminum alloy article.

The aluminum alloy article is solution heat treated at temperatures generally from about 880 to about 1,030° F. and, more specifically for Aluminum Alloy 2195, from about 900 to about 1,000° F. The solid solution heat treatment of the aluminum alloys articles occurs at these temperatures for durations generally from about a few minutes to 8 hours and, more typically, from about 30 minutes to about 4 hours. The solid solution heat treating of the aluminum alloy articles should be of a sufficient duration to allow substantially all soluble alloy components to enter into the solution.

After solid solution heat treating, fast cooling or quenching is performed on the aluminum alloy article. Fast cooling or quenching may be performed by various known processes in the art. Examples of quenching include water quenching, oil quenching, other liquid quenching or quenching by fast moving forced air. The quenching should occur quickly so as to maintain the super saturated solid solution from the solid solution heat treatment. The quenching of the aluminum alloy articles reduces the temperature from that in the solid solution heat treatment to generally room temperature (about 70° F.). The quenching is generally performed in from about 2 minutes to about 10 minutes.

As discussed above, cold work may be performed on the aluminum alloy articles of the present invention. Cold work is generally defined as the introduction of plastic deformation at or near room temperature performed prior to first artificially aging step. Various known cold working practices include stretching, cold rolling, compression and cold forging. Cold work is typically performed at or near room temperature. Cold work can stretch or compress some aluminum alloy articles from about 1 to about 10% and typically stretches or compresses those articles from about 2 to about 6%. Cold work is often performed on flat articles or products to reduce residual stress and increase strength after artificial aging. Cold work may not be performed on certain aluminum alloy articles, such as those with complicated shape forging or formed parts.

After quenching or the performing of the optional cold work, the age-hardenable aluminum alloy article is subjected to artificial aging. According to one artificial aging process of the present invention, the alloys discussed above (e.g., Al—Cu, Al—Cu—Li, Al—Li—Cu) include two step artificial aging.

The first artificial aging step of the present invention includes soaking the aluminum alloy article at a temperature generally from about 200 to about 340° F. and for a time from about 5 minutes to several months depending on the temperature. The soaking may occur in air, hot oil, salt bath, or molten metal as long as the medium does not damage the aluminum alloy. More specifically, the first artificial aging step of the present invention includes soaking the aluminum alloy at a temperature from about 275 to about 340° F. for a time for at least 30 minutes and generally from about 6 hours to about 50 hours. Optimal times typically vary depending upon alloy composition and age temperature.

The second artificial aging step of the present invention includes soaking the aluminum alloy at a temperature generally from about 250 to about 400° F. for a time from about 30 minutes to about 500 hours. More specifically, the second artificial aging step of the present invention includes soaking the aluminum alloy at a temperature from about 325 to about 380° F. for a time from about 4 hours to about 36 hours.

The temperature of the second artificial aging step of the present invention is typically from about 10 to about 100° F. higher than the temperature of the first artificial aging step and, more specifically, from about 15 to about 50° F. higher than the temperature of the first artificial aging step.

Some examples include a temperature of from about 200 to about 290° F. for a duration of from about 24 to about 72 hours for the first artificial aging step, and a temperature of from about 320 to about 380° F. for a duration of from about 2 to about 24 hours for the second artificial aging step. In another example, the first artificial aging step uses a temperature of from about 200 to about 310° F. for a duration of from about 12 to about 48 hours, while the second artificial aging step uses a temperature of from about 320 to about 355° F. for a duration of from about 8 to about 24 hours. In yet another example, the first artificial aging step uses a temperature of from about 310 to about 330° F. for a duration of from about 12 to about 36 hours, while the second artificial aging step uses a temperature of from about 340 to about 355° F. for a duration of from about 4 to about 24 hours.

The second artificial aging step of the present invention may take place directly after the first artificial aging step (i.e., when the aluminum alloy article is still warm). Alternatively, the second artificial aging step may take place after the aluminum alloy article has been cooled to a temperature, such as room temperature. If the aluminum alloy article is cooled, it needs to be heated to the temperature of the second artificial aging step-of the present invention.

In another process of the present invention, the article is hot deformed and then fast cooled or quenched. The hot deformation of the article may be performed at temperatures of from about 880 to about 1,030° F. The fast cooling or quenching is generally performed in the same manner and under the same conditions as described above. The article is then artificially aged at the first and second temperatures and respective durations as discussed above. Cold work may also be performed prior to the first artificially aging step. This process does not include a solid solution heat treatment step.

EXAMPLES

Example 1

An aluminum alloy article (Aluminum Alloy 2195 described above) was solid solution heat treated at about 930° F. for 30 minutes in an air furnace during superplastic forming process. After the solid solution heat treatment, the aluminum alloy article was quenched to room temperature by using forced air fans. Subsequently, the aluminum alloy article was artificially aged. The first artificial aging step was performed at an air temperature of 320° F. for 30 hours and then the second artificial aging step was performed at an air temperature of 350° F. for 16 hours on the aluminum alloy article. The aluminum alloy article was then cooled to room temperature.

One sample of the aluminum alloy article of Example 1 was then tested for ultimate tensile strength (UTS), tensile yield strength (TYS), elongation as determined by ASTM E577. The samples were tested about 2 hours after cooling to room temperature. The testing results of the sample of Example 1 are shown in the Table below.

Example 2

Example 2 was formed in the same manner of Example 1 except that the artificial aging steps were modified. Specifically, the first artificial aging step of Example 2 was performed at 320° F. for 30 hours and then the second artificial aging step was performed at 350° F. for 10 hours. One sample of the aluminum alloy article of Example 2 was tested for UTS, TYS and elongation with the results depicted in the Table below.

Comparative Examples 3–5

Example 3–5 were processed in the same manner of Example 1 except that the artificial aging step was modified. Examples 3–5 were comparative examples using a one step artificial aging step, instead of the two step artificial aging steps depicted in Examples 1 and 2. Each of the different temperatures and the time durations of the respective one step artificial aging steps of Examples 3–5 are shown in the Table below. Additionally, one sample of each of the Examples 3–5 was tested for UTS, TYS and elongation with the results depicted in the Table below.

THE TABLE

| | Example 1 | Example 2 | Example 3 | Example 4 | Example 5 |
|---|---|---|---|---|---|
| 1st Artificial Aging Step | | | | | |
| Temperature (° F.) | 320 | 320 | 320 | 320 | 320 |
| Duration (hours) | 30 | 30 | 20 | 30 | 40 |
| 2nd Artificial Aging Step | | | None[1] | None | None |
| Temperature (° F.) | 350 | 350 | None | None | None |
| Duration (hours) | 16 | 10 | None | None | None |
| Ultimate Tensile Strength (ksi) | 77.1 | 75.9 | 69.5 | 71.5 | 73.1 |
| Tensile Yield Strength (ksi) | 66.1 | 64.7 | 45.7 | 54.0 | 58.2 |
| Elongation (%) | 8.2 | 8.0 | 15.2 | 12.3 | 10.7 |

[1]Examples 3–5 did not have a second artificial aging step.

As shown in the Table above, the ultimate tensile strength (UTS) and the tensile yield strength (TYS) of the two step artificial aging steps of Examples 1 and 2 were unexpectedly much higher than the UTS and TYS of the one step artificial aging steps of Examples 3–5. Compare 77. 1 and 75.9 ksi with 69.5, 71.5 and 73.1 ksi for the UTS and compare 66.1 and 64.7 ksi with 45.7, 54.0, and 58.2 ksi for the TYS. The elongation values of Examples 1 and 2 were surprising also much lower than the elongation values of Examples 3–5. Compare 8.2 and 8.0% with 15.2, 12.3 and 10.7%.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A process for thermally treating an article made from an alloy comprising at least aluminum, copper and lithium, the process comprising the acts of:

solid solution heat treating the article;

quenching the article;

heating the article to a first temperature of from about 275 to about 340° F.;

artificially aging the article at the first temperature for a duration of at least 30 minutes; and artificially aging the article at a second temperature of from about 325 to about 380° F. for a duration of from about 4 hours to about 36 hours, the second temperature being greater than the first temperature by at least 10° F., wherein the alloy is an AA2195 alloy.

2. The process of claim 1 further including performing cold work to the article prior to the artificially aging at the first temperature.

3. The process of claim 1 wherein the article is solid solution heat treated at a temperature from about 880 to about 1,030° F.

4. The process of claim 1 wherein the article is artificially aged at the first temperature for a duration of from about 6 hours to about 50 hours.

5. The process of claim 1 wherein the second temperature is greater than the first temperature by from about 15 to about 50° F.

6. The process of claim 1 wherein the article is artificially aged at the first temperature of from about 310 to about 330° F. for a duration of from about 12 to about 36 hours and the article is artificially aged at the second temperature of from about 340 to about 355° F. for a duration of from about 4 to about 24 hours.

* * * * *